US009314656B2

(12) United States Patent
Huang

(10) Patent No.: US 9,314,656 B2
(45) Date of Patent: Apr. 19, 2016

(54) TRAINING MACHINE OF LOAD FORCE SIMULATION

(71) Applicant: PROTUG CO., LTD., Taipei (TW)

(72) Inventor: Jui-Tung Huang, Taipei (TW)

(73) Assignee: Protug Co., Ltd., Taipei (TW)

( * ) Notice: Subject to any disclaimer, the term of this patent is extended or adjusted under 35 U.S.C. 154(b) by 0 days.

(21) Appl. No.: 14/659,999

(22) Filed: Mar. 17, 2015

(65) Prior Publication Data

US 2015/0273261 A1 Oct. 1, 2015

(30) Foreign Application Priority Data

Mar. 25, 2014 (TW) ..... 103111081 A

(51) Int. Cl.
*A63B 21/00* (2006.01)

(52) U.S. Cl.
CPC ..... *A63B 21/00007* (2013.01); *A63B 21/00036* (2013.01); *A63B 21/151* (2013.01); *A63B 21/158* (2013.01)

(58) Field of Classification Search
USPC ..... 482/1–148
See application file for complete search history.

(56) References Cited

U.S. PATENT DOCUMENTS 5,147,263 A * 9/1992 Mueller ..... A63B 21/0628 482/112
5,151,071 A * 9/1992 Jain ..... A63B 21/0628 482/101
5,338,271 A * 8/1994 Wang ..... A63B 21/154 482/118
5,403,257 A * 4/1995 Lehtonen ..... A63B 21/023 482/112
5,738,611 A * 4/1998 Ehrenfried ..... A63B 21/023 482/129
6,926,649 B2 * 8/2005 Slawinski ..... A63B 21/00181 482/104
8,323,158 B2 * 12/2012 Keiser ..... A63B 21/0087 482/100
8,715,142 B1 * 5/2014 Leach ..... A63B 21/159 482/102
9,017,234 B2 * 4/2015 Tai ..... A63B 21/0083 482/112
2007/0259763 A1 * 11/2007 McKeown ..... A63B 22/14 482/146
2007/0287612 A1 * 12/2007 Cha ..... A63B 21/008 482/111
2008/0287267 A1 * 11/2008 Ellis ..... A63B 21/00076 482/54
2014/0342878 A1 * 11/2014 Hashish ..... A63B 21/0058 482/8

* cited by examiner

*Primary Examiner* — Stephen Crow
(74) *Attorney, Agent, or Firm* — Rosenberg, Klein & Lee

(57) ABSTRACT

A training machine of load force simulation has a damping unit comprises a press cylinder which includes a cylinder, a movable piston rod, and a press source; a controller is coupled to the press source of the damping unit and a load cell for calculating and controlling the load value of the load cell, allowing the elevating and lowering of a pulley system thereof by adjusting the damping force via the piston rod. Also, the pulley system comprises a plurality of movable pulleys to equally bear the load force from the rope, saving the efforts for operating and retarding the retrieving force of the rope for safety. The present invention is therefore able to replace complex decelerating machines and massive weight blocks in apparatus suchlike with features of small volumes as less space needed, less noises, and no restrictions of setting areas due to no need of electricity. Furthermore, it comprises an operation interface for direct controlling of the load force, featuring more conveniences and no interruption when practicing the operation.

6 Claims, 10 Drawing Sheets

TRAINING MACHINE OF LOAD FORCE SIMULATION

BACKGROUND OF THE INVENTION

1. Field of the Invention

The present invention relates to a training machine of load force simulation, particularly to one that can simulate the load force by a controller to conduct a tug of war practice with the operator to achieve the purpose of fitness training and that has a plurality of movable pulleys to equally bear the load force, achieving an effort-saving feature; when the operator releases less force, the present invention can also automatically control the corresponding damping force, retarding the load force and avoiding injuries to the operator and therefore achieving a safe feature.

2. Description of the Related Art

FIGS. 1, 2, 3, and 3A are different kinds of fitness training machines invented for variables such as the number of operators, places for operation, and weight levels; it is further illustrated the simulation of load force, the mode of practicing, and the structure of providing stable load force in each figure.

FIG. 1 is a training machine of tug of war 10 disclosed in Taiwan Patent Publication No. I375580. It is also a fitness training machine. The invention has a decelerating structure 11 including a servo motor 111, a first decelerating gear set 112 driven by the servo motor 111, a second decelerating gear set 113 arranged in a distance from the first decelerating gear set 112, and a driving chain 114 rolling around the first and second decelerating gear set 112, 113; it is driven by the first decelerating gear set 112 and therefore driving the second decelerating gear set 113 along a closed trail. The decelerating structure 11 is connected to a rope winder 12 that can simulate the load force by winding a rope 13. However, the friction between the first and second decelerating gear set 112, 113 and the driving chain 14 may affect the operation, and the decelerating structure 11 has to take the driving force of the servo motor 111 and the loading of the rope 13, causing more efforts in operation. Besides, when the operators C are decreasing the pulling force, the loading of the rope 13 would drop suddenly and cause a sudden winding of the rope winder 12 which may hurt the operators C.

FIG. 2 is a conventional tug of war training machine for multiple operators 20 disclosed in Taiwan Patent Publication No. I335831. It is also a fitness training machine which comprises a first pulley 21, a second pulley 22 arranged higher than the first pulley 21, a weight block tray 23 having a plurality of weight blocks 25 thereon and a plurality of buffers 24 arranged below, a rope 26 having the middle section thereof overstriding the groove on the second pulley 22 and an end thereof overstriding the groove on the first pulley 22, a weight blocks and rope connecting device 27 connecting with the other end of the rope 26; whereby the weight blocks and rope connecting device 27 simulates the load force with the weight blocks 25 for operation. However, there is only the second pulley 22 bearing the load force from the rope 26 and the resistant gravity of the weight blocks 25, causing it more efforts in operating; and when the operators C suddenly decrease the pulling force, the loading of the rope 26 would also decrease suddenly and cause a sudden dropping of the weight blocks 25 which may hurt the operators C.

FIG. 3 is a conventional tug of war training machine for single operator 30 disclosed in Taiwan Patent Publication No. M304359. It is also a fitness training machine which comprises a steel rope 31 with an end thereof rolling around a pulley assembly 32 and connecting to a tug of war rope 33, and the other end thereof connecting to a plurality of weight blocks 34 so that the steel rope 31 can simulates the load force with the weight blocks 34 for operation. However, there is only the pulley assembly 32 bearing the load force from the tug of war rope 33 and the resistant gravity of the weight blocks 34, causing it more efforts in operating; and when an operator C suddenly decreases the pulling force, the loading of the tug of war rope 33 would also decrease suddenly and cause a sudden dropping of the weight blocks 34 which may hurt the operator C.

FIG. 3A is a conventional fitness training machine for single operator 30A which comprises a steel rope 31A rolling around a pulley set 32A and connecting to a pull down bar 33A with an end, and connecting to a plurality of weight blocks 34A so that the steel rope 31A can simulates the load force with the weight blocks 34A for operation. However, there is only the pulley set 32A bearing the load force from the pull down bar 33A and the resistant gravity of the weight blocks 34A, causing it more efforts in operating; and when an operator C suddenly decreases the pulling force, the loading of the tug of war rope 33A would also decrease suddenly and cause a sudden dropping of the weight blocks 34A which may hurt the operator C.

In short, all the training machines disclosed above have problems during operating as below:

1. The rope winder 12, second pulley 22, pulley assembly 32, and pulley set 32A are the components bearing the loading, but when they are bearing too much loading, it would cause much more efforts in the operation process and the components tend to be damaged more easily.

2. The driving components of complex decelerating machine 11 and the weight blocks 25, 34, 34A with large volumes have problems of space occupation, high noises, and restrictions of setting area due to the need of electricity. On the other hand, when the operators decreases the pulling force in a sudden or does not have enough strength to pull, the rope 13, 26, tug of war rope 33, and pull down bar 33A would have strong retrieving force that may hurt the operators.

3. The weight blocks 25, 34, 34A on the training machines have to be increased or decreased piece by piece, causing inconveniences for the operators and interruptions in the training process.

Hence, it is desirable to solve the problems mentioned above and make improvement from them in the present invention.

SUMMARY OF THE INVENTION

A primary object of the present invention is to provide a training machine of load force simulation that has the components thereof equally bearing the load force so as to solve the problems of bearing exceeding load force and requiring more efforts to operate in the prior art.

Another object of the present invention is to provide a training machine of load force simulation that can retard the retrieving force of the rope so as to solve the problem of strong retrieving force causing sudden retrieval in the prior art, ensuring more safety in the operating process.

Yet another object of the present invention is to provide a training machine of load force simulation that can adjust the load force by an operation interface, featuring more conveniences and no interruption in the operating process.

To achieve the objects mentioned above, the present invention comprises a housing; a damping unit being disposed inside the housing and comprising a press cylinder including a cylinder, a movable piston rod, and a pressure source to elevate the piston rod; a load cell disposed inside the housing;

a controller coupled to the pressure source of the damping unit and the load cell in order to calculate the load value set by the load cell so that when the load value is beyond the allowable range, a signal would be transmitted back to the controller to control the damping force; a pulley system having the middle thereof connected to and elevating with the piston rod of the damping unit, having a middle movable pulley being arranged in the middle section thereof and at least one left movable pulley and one right movable pulley being arranged symmetrically on both sides of the middle movable pulley to keep the balance of the pulley system during the elevation; at least one left fixed pulley with the axis thereof fixed inside the housing, arranged at a lower position between the middle movable pulley and the left movable pulley; at least one right fixed pulley with the axis thereof fixed inside the housing, arranged at a lower position between the middle movable pulley and the right movable pulley; a steel rope connecting the load cell with one end and rolling along partial circumference of the left movable pulley, then downward along partial of the left fixed pulley and upward along partial of the middle movable pulley; then downward again along partial of the right fixed pulley and upward again along partial of the right movable pulley, then finally reaching out the housing via an opening, forming a free end of the other end; and a rope having one end thereof connecting to the free end of the steel rope; whereby the movable pulleys are equally bearing the load force from the rope in which when the load is exceeding the load value of the load cell, the pulley system would be lowered and the damping force of the damping unit would be decreased, and when the load is less than the load value of the load cell, the pulley system would be elevated and the damping force of the damping unit would be increased.

Furthermore, the press cylinder thereof comprises either a hydraulic cylinder or a pneumatic cylinder, and the present invention includes at least two guide rails, each arranged on one side of the middle movable pulley, and the guide rails have opened ends and engage with the pulley system for the axles of the left and right movable pulley to roll along.

Still, the present invention further includes a set of guide idlers arranged between the right movable pulley and the opening for the steel rope to stretch out, an operation interface disposed on the housing and coupled to the controller in order to control the load value of the load cell, and a display unit disposed on the housing and coupled to the controller in order to display the load value of the load cell.

With structures disclosed above, the present invention has the pulley system for loading to equally bear the load force and save the efforts fo r operation; on the other hand, it has the damping unit for retarding the strong retrieving force of the rope to ensure more safety. By having the damping force from the damping unit to elevate and lower the pulley system, the present invention has features of small volumes, less noises, and no restrictions of setting areas. In addition, the operation interface is able to adjust the load force directly, featuring more conveniences and no interruption during operation.

DETAILED DESCRIPTION OF THE PREFERRED EMBODIMENT

Figure 1:
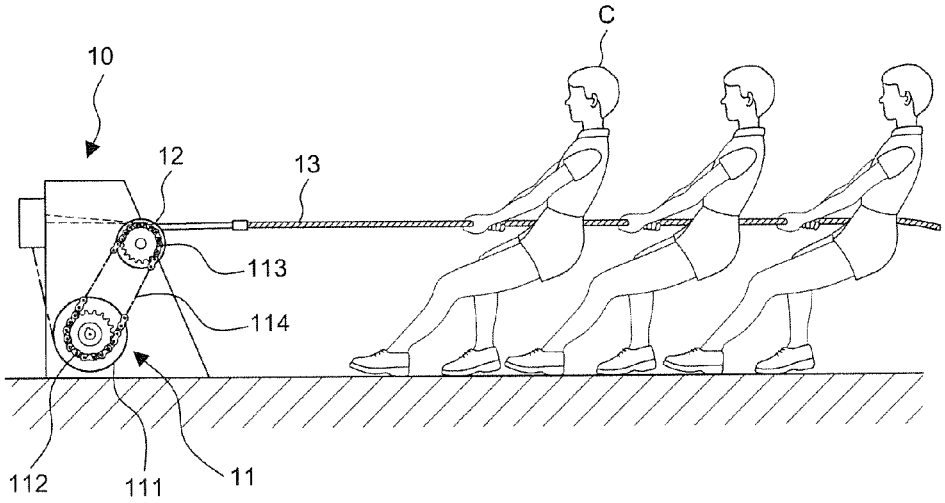
FIG.1 PRIOR ART
FIG. 1 is a schematic diagram of a conventional training machine of tug of war.
Figure 2:
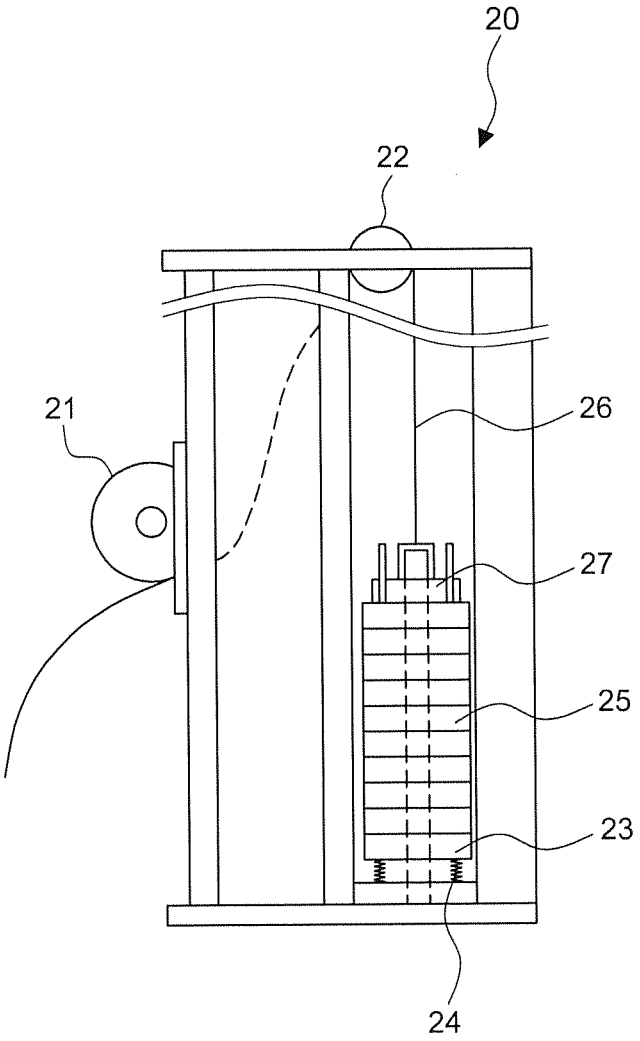
FIG.2 PRIOR ART
FIG. 2 is a schematic diagram of a conventional tug of war training machine for multiple operators.
Figure 3:
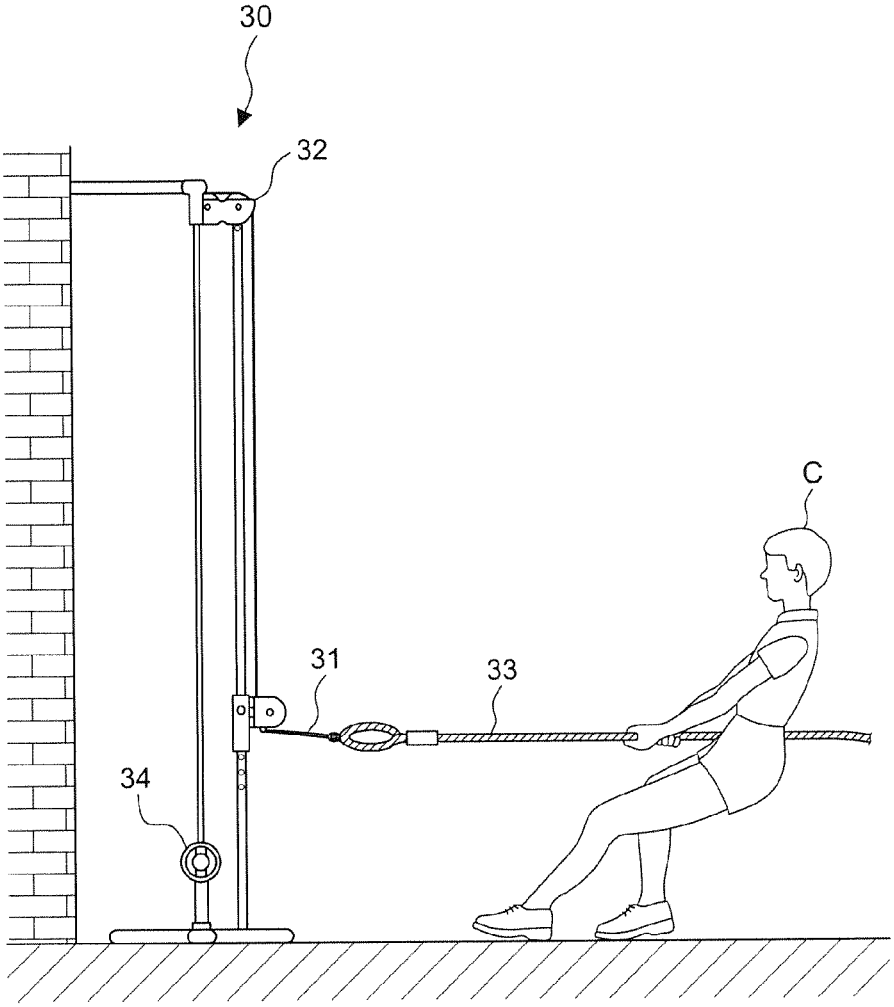
FIG.3 PRIOR ART
FIG. 3 is a schematic diagram of a conventional tug of war training machine for single operator.
Figure 3A:
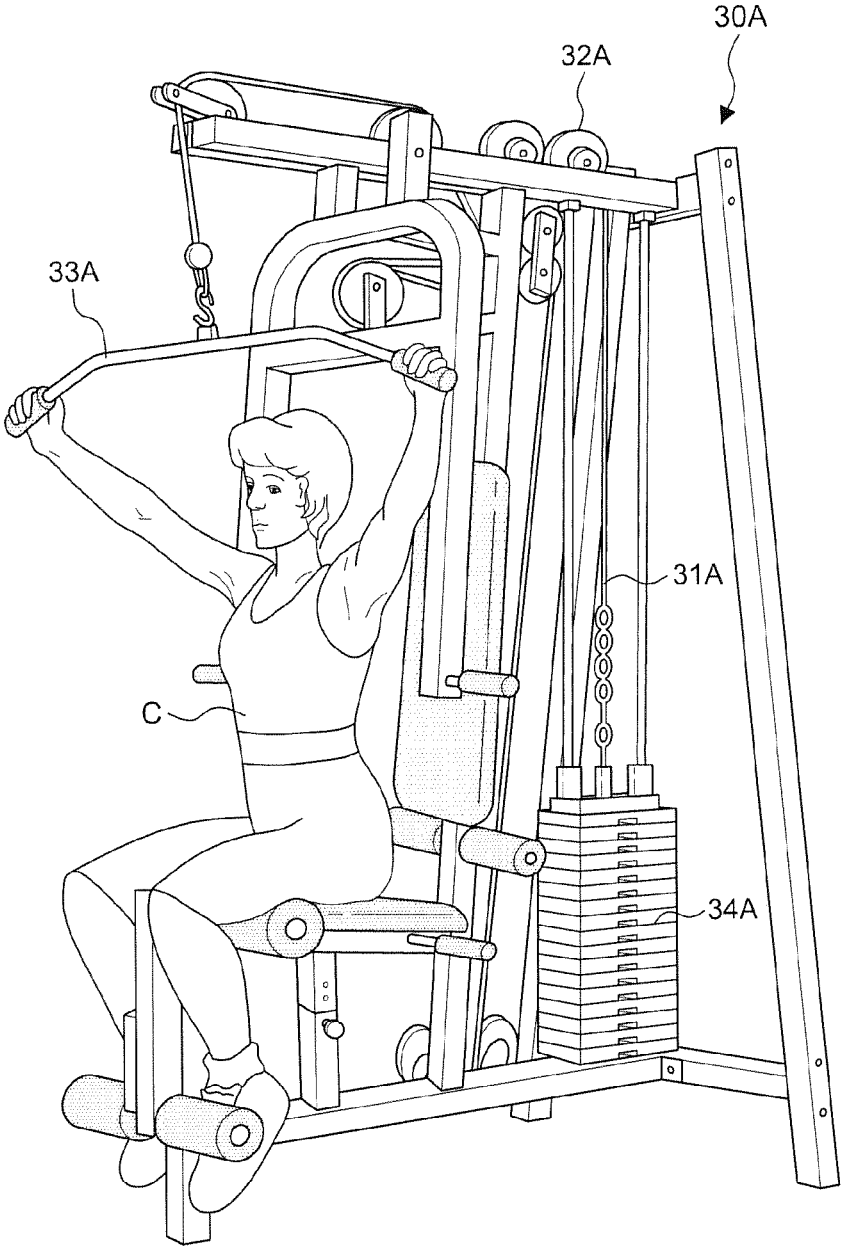
FIG.3A PRIOR ART
FIG. 3A is a schematic diagram of a conventional fitness training machine for single operator.

Referring to FIGS. 4-9, in a preferred embodiment, the present invention comprises a housing 41, a damping unit 42, a load cell 43, a controller 44, a pulley system 45, at least one left fixed pulley 46, at least one right fixed pulley 47, a steel rope 48, and a rope 49.

The damping unit 42 is disposed inside the housing 41 and comprises a press cylinder including a cylinder 421, a movable piston rod 422, and a pressure source 423 to elevate the piston rod; in this embodiment, the press cylinder comprises either a hydraulic cylinder or a pneumatic cylinder.

Figure 4:
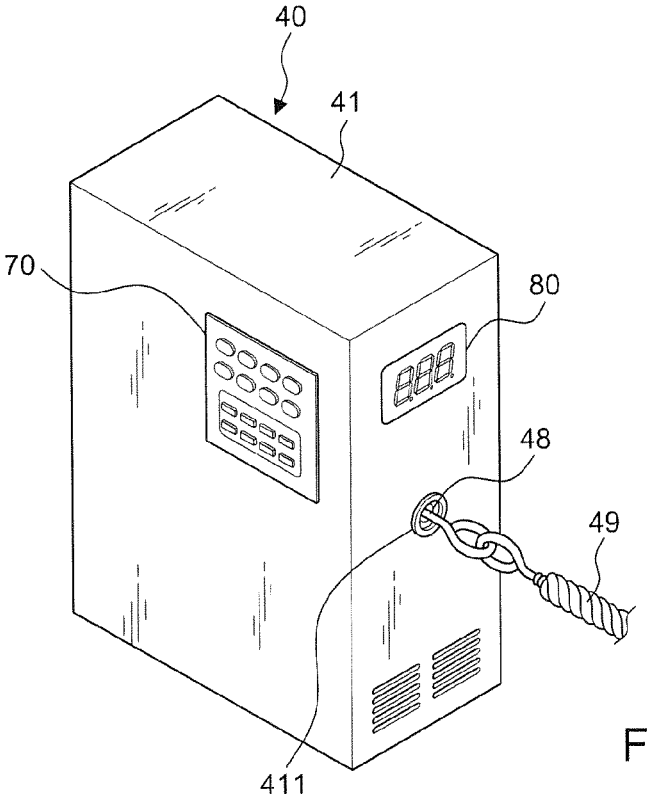
FIG. 4 is a perspective view of the present invention.
Figure 4A:
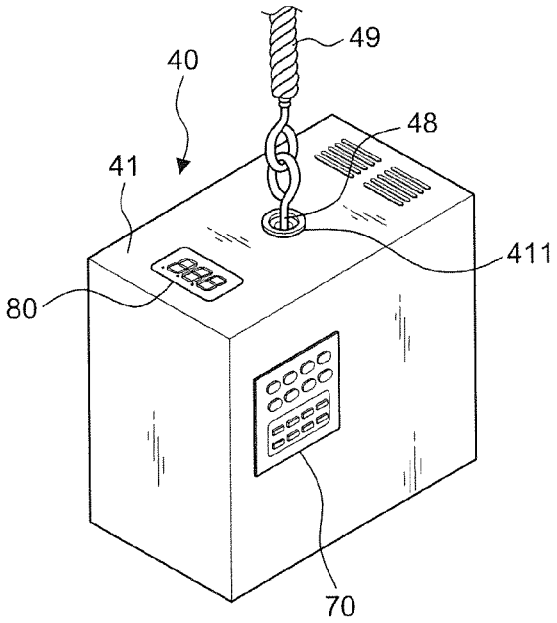
FIG. 4A is another perspective view of the present invention.
Figure 5:
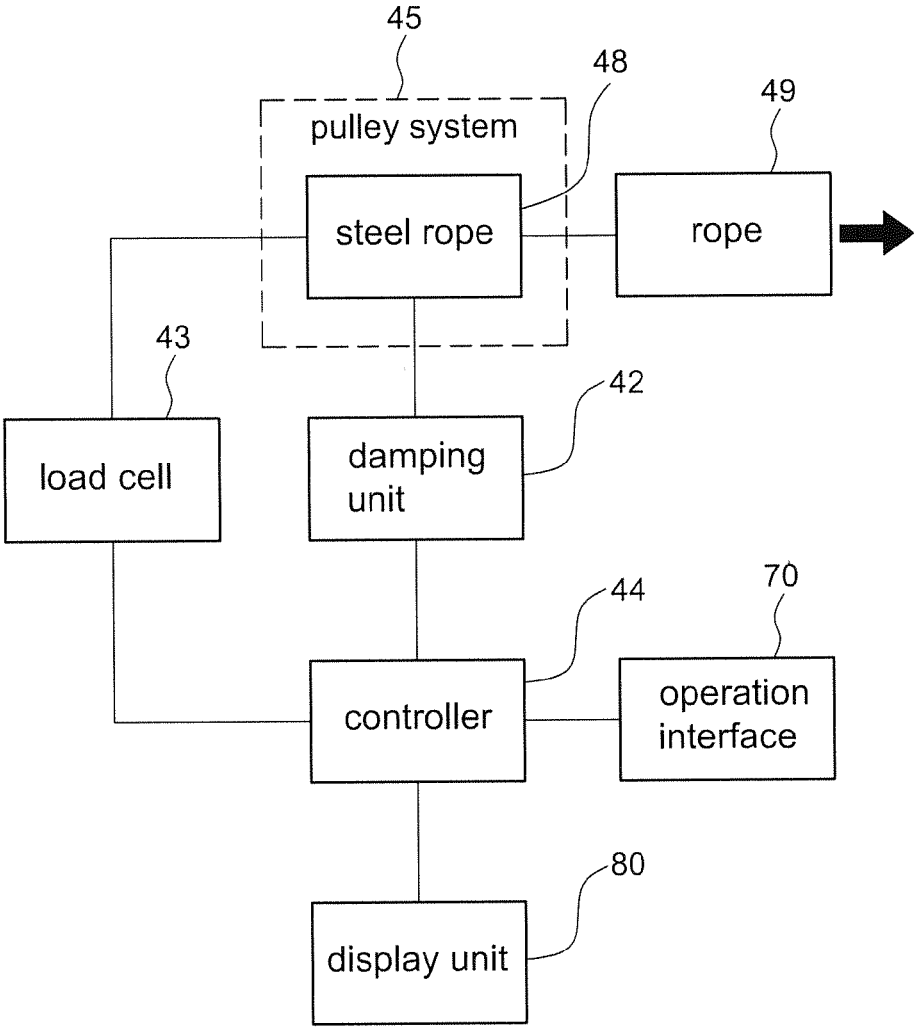
FIG. 5 is a circuit block diagram of the present invention.

The load cell 43 is disposed inside the housing 41. The controller 44 is coupled to the pressure source 423 of the damping unit 42 and the load cell 43 in order to calculate the load value set by the load cell 43 so that when the load value is beyond the allowable range, a signal would be transmitted back to the controller 44 to control the damping force; in this embodiment, the present invention can be a large machine as shown in FIG. 4 for training of tug of war, or it can be a small machine as shown in FIG. 4A for fitness training; both of which have an operation interface 70 and a display unit 80 disposed on the housing and coupled to the controller 44 with reference to the circuit block diagram in FIG. 5 in order to display the load value of the load cell 44. The load cell 44 can set the load value in accordance with the numbers of the operators and the level of the weight for training by the operation interface 70 and the display unit 80.

Figure 6A:
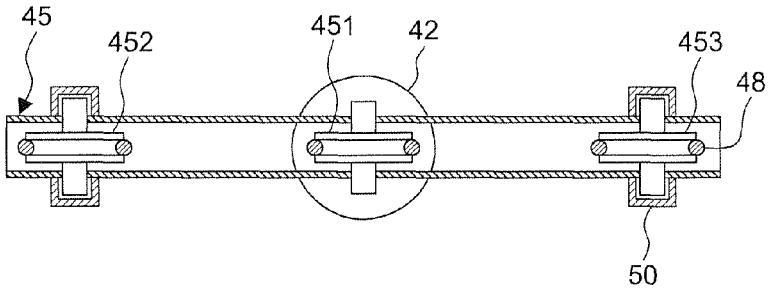
FIG. 6A is a sectional view along line 6A-6A in FIG. 6.
Figure 6:
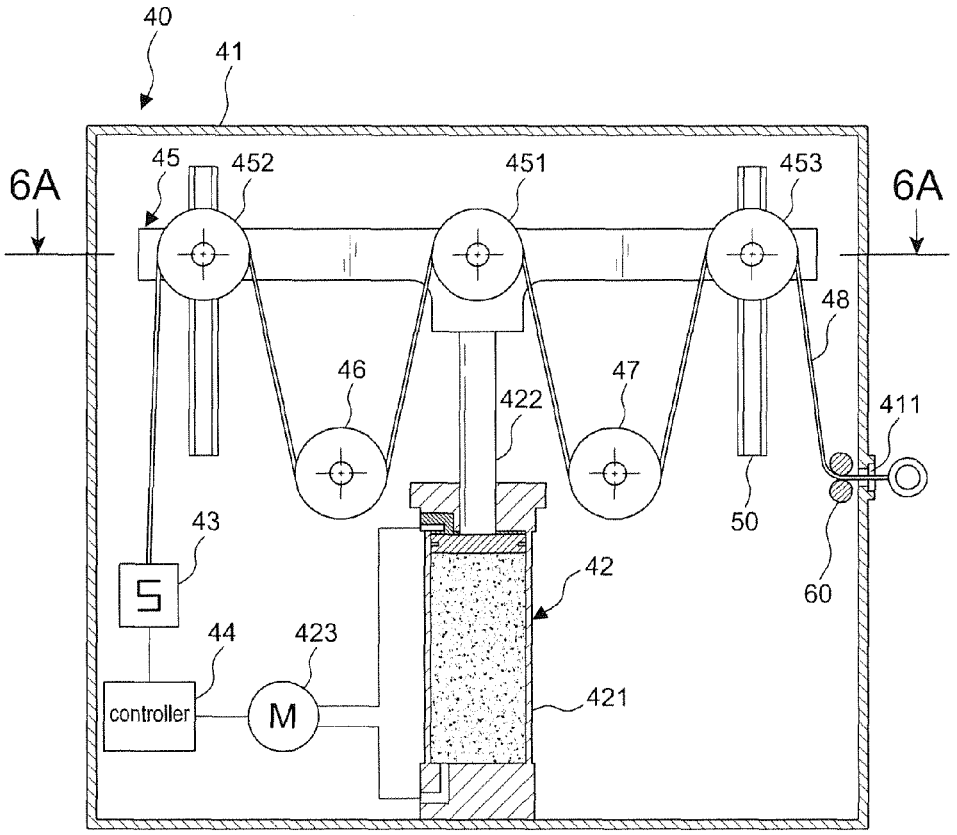
FIG. 6 is a perspective view of the internal structure of the present invention.
Figure 7:
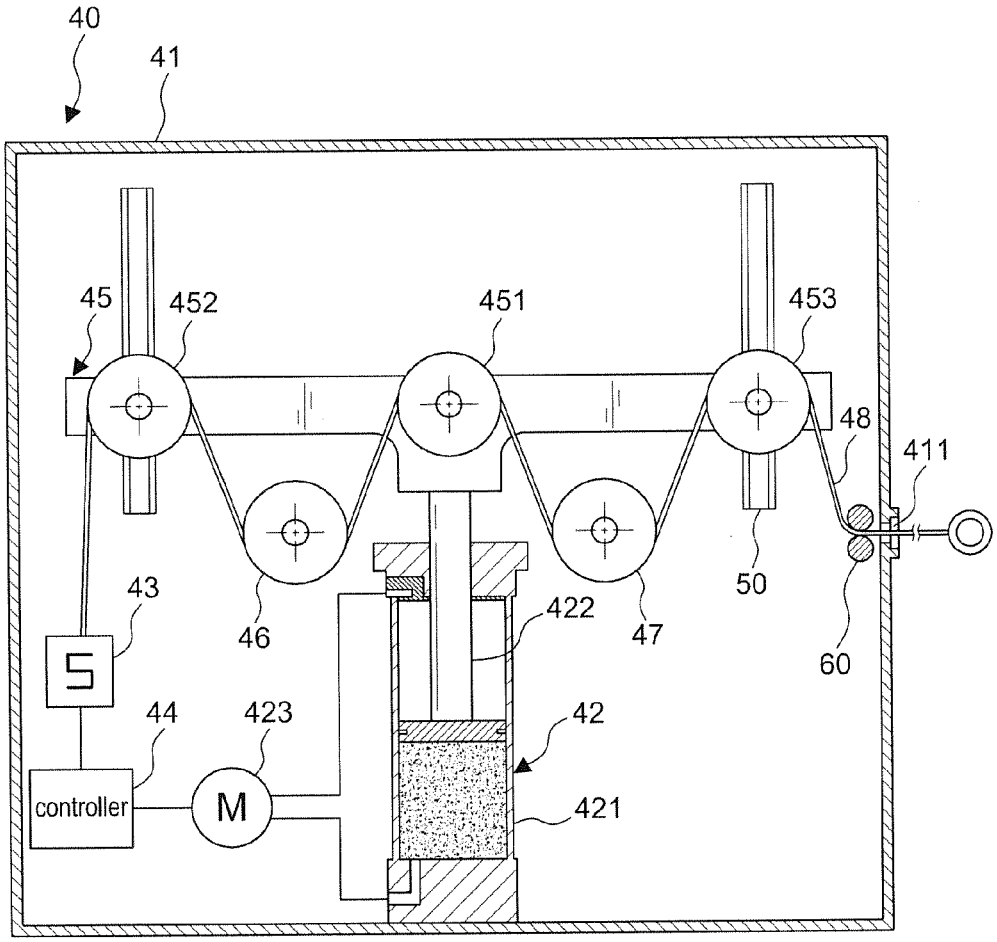
FIG. 7 is an application example of the present invention.

The pulley system 45 has the middle thereof connected to and elevating with the piston rod 422 of the damping unit 42 with a middle movable, pulley 451 being arranged in the middle section thereof and at least one left movable pulley 452 and one right movable pulley 453 being arranged symmetrically on both sides of the middle movable pulley 451 to keep the balance of the pulley system 45 while elevating and lowering. Referring to FIGS. 6, 6A, and 7, in this embodiment, the present invention includes at least two guide rails 50, each arranged on one side of the middle movable pulley 451, and the guide rails 50 have opened ends and engage with the pulley system 45 for the axles of the left and right movable pulley 452, 453 to roll along; but it is not limited to such application.

The left fixed pulley 46 has the axis thereof fixed inside the housing 41 and is arranged at a lower position between the middle movable pulley 451 and the left movable pulley 452; the right fixed pulley 47 has the axis thereof fixed inside the housing 41 and is arranged at a lower position between the middle movable pulley 451 and the right movable pulley 453.

The steel rope 48 is connecting the load cell 43 with one end and rolling along partial circumference of the left movable pulley 452, then downward along partial of the left fixed pulley 46 and upward along partial of the middle movable pulley 451; then downward again along partial of the right fixed pulley 47 and upward again along partial of the right movable pulley 453, then finally reaching out the housing 41 via an opening 411, forming a free end of the other end for the steel rope 48 to stretch out; and the rope 49 has one end thereof connecting to the free end of the steel rope 48;

whereby the movable pulleys are equally bearing the load force from the rope 49 in which when the loading is exceeding the load value of the load cell 43, the pulley system 45 would be lowered and the damping force of the damping unit 42 would be decreased, and when the loading is less than the load value of the load cell 43, the pulley system 45 would be elevated and the damping force of the damping unit 42 would be increased.

Figure 8:
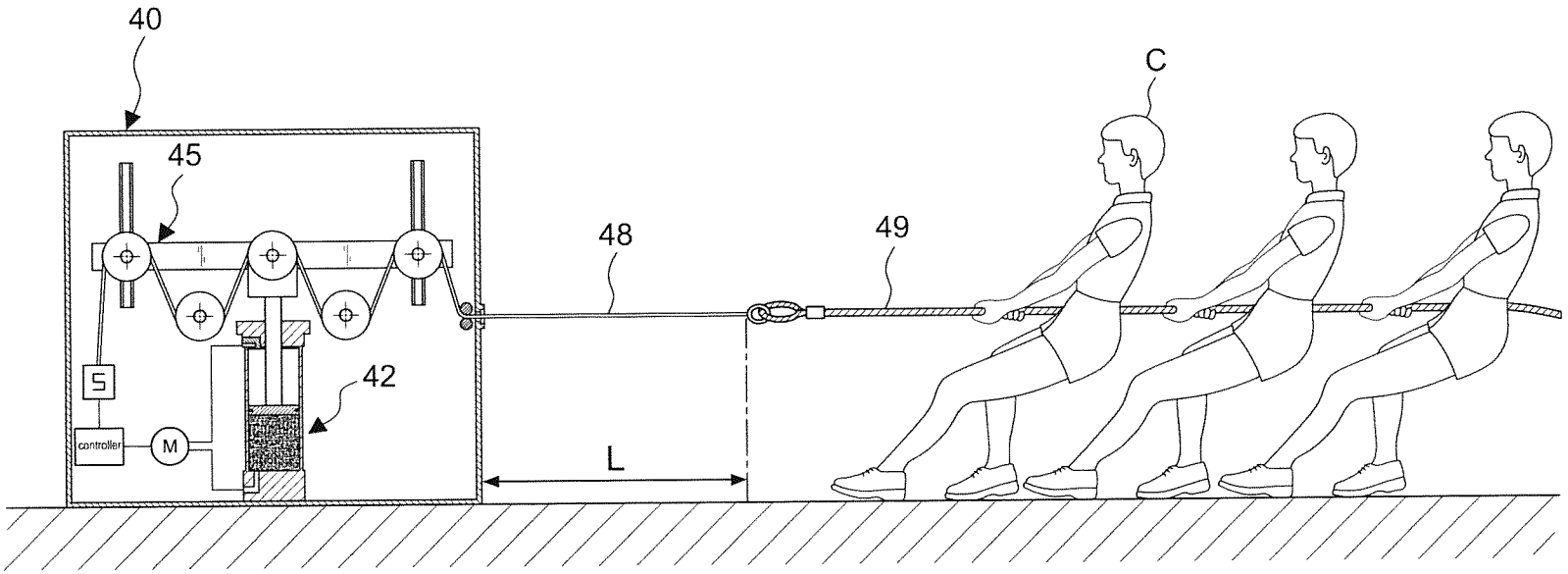
FIG. 8 is a practical application view of the present invention.

Referring to FIGS. 4 and 8, the training machine of load force simulation 40, i.e. the present invention, can be a large machine applied in training of tug of war. In this embodiment, the design of pulley system 45 and damping unit 42 simulate a stable load force for the operators C to practice tug of war training with the rope 49. When the operators C pull the out the steel rope 48 in 4 meters length L, they succeed in the practice training.

Figure 9:
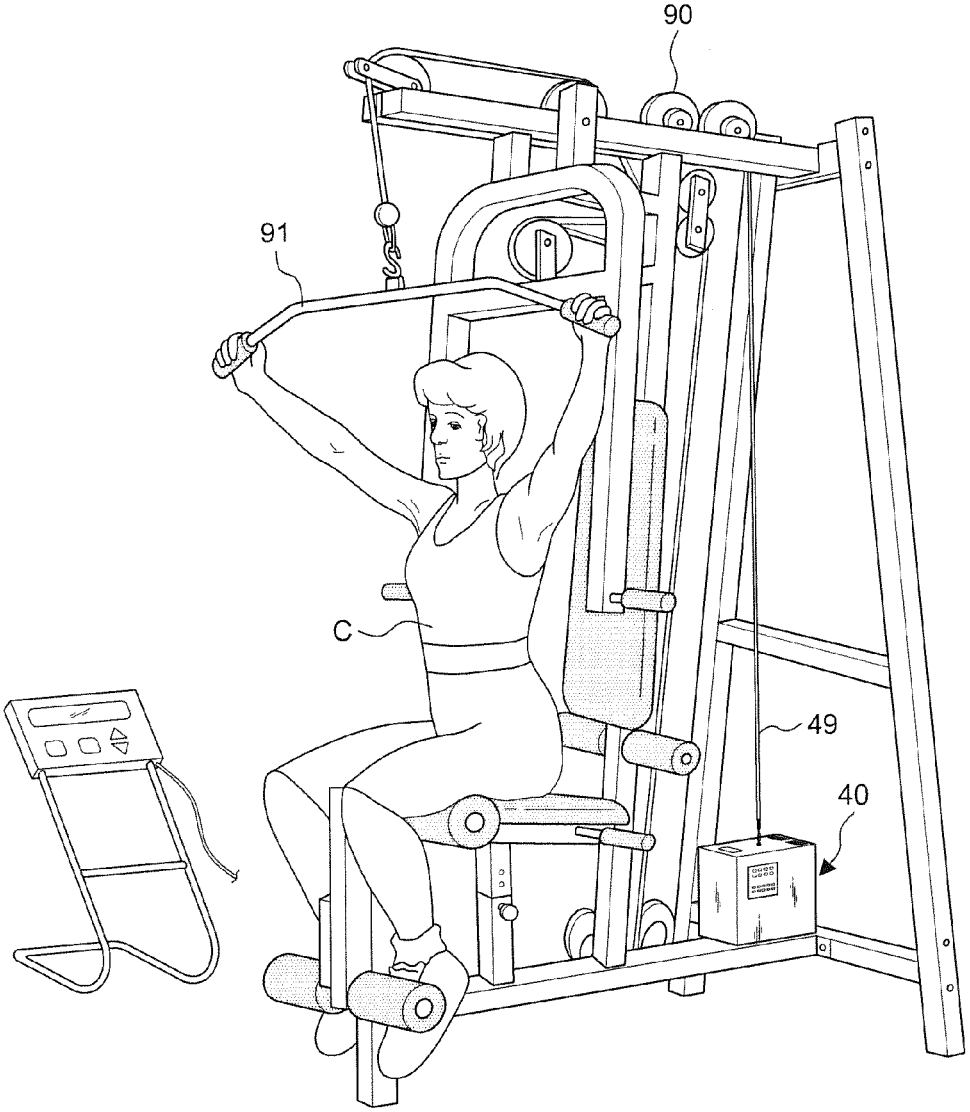
FIG. 9 is another practical application view of the present invention.

Further referring to FIGS. 4A and 9, the training machine of load force simulation 40, i.e. the present invention, can be a small machine applied in fitness training. In this embodiment, the design of pulley system 45 and damping unit 42 simulate a stable load force for an operator C to practice fitness training with the rope 49. When the operator C pulls the pull down bar 91 and creates load force via the rope 49 and the pulley system 90, the training machine of load force simulation 40 is simulating the load force for the operator to practice fitness training.

In short, the pulley system 45 can not only bear the load force but also save the efforts in operation, and the damping unit 42 can not only operate the pulley system 45 but also retard the strong retrieving force for safety, allowing the present invention to replace complex decelerating machines and massive blocks in apparatus suchlike with features of small volumes as less space needed, less noises, and no restrictions of setting areas due to no need of electricity. Furthermore, the operation interface 70 can directly control the load force by the controller 44, featuring more conveniences and no interruption during operation.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A training machine of load force simulation, comprising:

a housing;

a damping unit being disposed inside the housing and comprising a press cylinder including a cylinder, a movable piston rod, and a pressure source to elevate the piston rod;

a load cell disposed inside the housing;

a controller coupled to the pressure source of the damping unit and the load cell in order to calculate the load value set by the load cell so that when the load value is beyond the allowable range, a signal would be transmitted back to the controller to control the damping force;

a pulley system having the middle thereof connected to and elevating with the piston rod of the damping unit, having a middle movable pulley being arranged in the middle section thereof and at least one left movable pulley and one right movable pulley being arranged symmetrically on both sides of the middle movable pulley to keep the balance of the pulley system while elevating and lowering;

at least one left fixed pulley with the axis thereof fixed inside the housing, arranged at a lower position between the middle movable pulley and the left movable pulley;

at least one right fixed pulley with the axis thereof fixed inside the housing, arranged at a lower position between the middle movable pulley and the right movable pulley;

a steel rope connecting the load cell with one end and rolling along partial circumference of the left movable pulley, then downward along partial of the left fixed pulley and upward along partial of the middle movable pulley; then downward again along partial of the right fixed pulley and upward again along partial of the right movable pulley, then finally reaching out the housing via an opening, forming a free end of the other end for the steel rope to stretch out; and a rope having one end thereof connecting to the free end of the steel rope;

whereby the movable pulleys are equally bearing the load force from the rope in which when the loading is exceeding the load value of the load cell, the pulley system would be lowered and the damping force of the damping unit would be decreased, and when the loading is less than the load value of the load cell, the pulley system would be elevated and the damping force of the damping unit would be increased.

2. The training machine of load force simulation as claimed in claim 1, wherein the press cylinder comprises either a hydraulic cylinder or a pneumatic cylinder.

3. The training machine of load force simulation as claimed in claim 1, wherein the present invention includes at least two guide rails, each arranged on one side of the middle movable pulley, and the guide rails have opened ends and engage with the pulley system for the axles of the left and right movable pulley to roll along.

4. The training machine of load force simulation as claimed in claim 1, wherein the present invention further includes a set of guide idlers arranged between the right movable pulley and the opening for the steel rope to stretch out.

5. The training machine of load force simulation as claimed in claim 1, wherein the present invention further includes an operation interface disposed on the housing and coupled to the controller in order to control the load value of the load cell.

6. The training machine of load force simulation as claimed in claim 1, wherein the present invention further includes a display unit disposed on the housing and coupled to the controller in order to display the load value of the load cell.

* * * * *